US009551050B2

(12) United States Patent
Huskamp et al.

(10) Patent No.: US 9,551,050 B2
(45) Date of Patent: Jan. 24, 2017

(54) ALUMINUM ALLOY WITH ADDITIONS OF SCANDIUM, ZIRCONIUM AND ERBIUM

(75) Inventors: Christopher S. Huskamp, St. Louis, MO (US); Christopher Booth-Morrison, Quebec (CA); David C. Dunand, Evanston, IL (US); David N. Seidman, Skokie, IL (US); James M. Boileau, Novi, MI (US); Bita Ghaffari, Ann Arbor, MI (US)

(73) Assignees: The Boeing Company, Chicago, IL (US); Ford Global Technologies, LLC, Dearborn, MI (US); Northwestern University, Evanston, IL (US)

( * ) Notice: Subject to any disclaimer, the term of this patent is extended or adjusted under 35 U.S.C. 154(b) by 949 days.

(21) Appl. No.: 13/408,027

(22) Filed: Feb. 29, 2012

(65) Prior Publication Data

US 2013/0220497 A1 Aug. 29, 2013

(51) Int. Cl.

| | |
|---|---|
| ***C22F 1/04*** | (2006.01) |
| ***C22C 21/00*** | (2006.01) |
| ***C22C 21/02*** | (2006.01) |
| ***C22F 1/043*** | (2006.01) |

(52) U.S. Cl.

CPC ..... *C22C 21/00* (2013.01); *C22C 21/02* (2013.01); *C22F 1/04* (2013.01); *C22F 1/043* (2013.01)

(58) Field of Classification Search

CPC ..... C22F 1/04; C22F 1/043; C22C 21/00; C22C 21/02; C22C 21/04

USPC ..... 420/528, 548, 552; 148/437, 688

See application file for complete search history.

(56) References Cited

U.S. PATENT DOCUMENTS

| | | | | |
|---|---|---|---|---|
| 6,248,453 | B1 | 6/2001 | Watson | |
| 2003/0219353 | A1 | 11/2003 | Warner et al. | |
| 2009/0226343 | A1* | 9/2009 | Telioui et al. | 420/535 |
| 2010/0139815 | A1 | 6/2010 | Pandey | |
| 2011/0259479 | A1 | 10/2011 | Telioui et al. | |

FOREIGN PATENT DOCUMENTS

| | | |
|---|---|---|
| CN | 102 127 665 A | 7/2011 |
| CN | 102127655 A | 7/2011 |
| CN | 102127665 | 7/2011 |

OTHER PUBLICATIONS

Belov, N.A, A.A Aksenov, and D.G Eskin. "Iron as an Impurity in Aluminum Alloys." Iron in Aluminium Alloys: Impurity and Alloying Element. London: Taylor and Francis, 2002. 185-86.*

Booth-Morrision et al., Coarsening resistance at 400° C. of precipitation-strengthened Al—Zr—Sc—Er alloys, Acta Matar., 59 (2011), pp. 7029-7042.*

Kamardinkin et al., *Isothermal Sections of the Al—Sc—Zr System at 550 and 600° C. in the Region Enriched in Aluminum*, Izy. Akad. Nauk SSSR, Met. No. 4, p. 214 (1991).

Knipling et al., *Criteria for Developing Castable, Creep-resistant Aluminum Alloys*, Z. Metallkd., 97:246 (2006).

Marquis et al., *Nanoscale Structural Evolution of Al3Sc Precipitates in Ai(Sc) Alloys*, Acta Mater., 49:1909 (2001).

(Continued)

*Primary Examiner* — Jessee Roe
*Assistant Examiner* — Anthony Liang
(74) *Attorney, Agent, or Firm* — Walters & Wasylyna LLC

(57) ABSTRACT

An aluminum alloy including additions of scandium, zirconium, erbium and, optionally, silicon.

8 Claims, 12 Drawing Sheets

(56) References Cited

OTHER PUBLICATIONS

Seidman, *Precipitation strengthening at ambient and elevated temperatures of heat-treatable Al(Sc)* alloys, Acta Mater., 50:4021(2002).
Royset et al., *Scandium in aluminium alloys*, Int. Mater. Rev., 50:19 (2005).
Drits et al., *Ageing of Alloys Al-0.3 at % Sc*, Anastas'eva Gk Phys. Met. Phys. Metall., 57:1172 (1984).
Drits et al., *The effect of Solution Treatment on Aging Processes of Al-Sc*, Salawa J. Cryst. Res. Technol., 19:1325 (1984).
Sawtell et al., *Exploratory alloy development in the system Al—Sc-X*, The Minerals, Metals and Materials Society, p. 409 (1988).
Yelagin et al., *Influence of Zirconium Additions of Ageing of Al—Sc Alloys*, Phys. Met. Phys. Metall., 60:97 (1985).
Tolley et al., *Segregation in Al3(Sc,Zr) precipitates in Al—Sc—Zr alloys*, Dahmen U. Scr. Mater., 52:621 (2005).
Forbord et al.,*Three dimensional atom probe investigation on the formation of A13(Sc,Zr)-dispersoids in aluminium alloys*, Marthinsen K. Scr. Mater., 51:333 (2004).
Clouet et al., *Complex precipitation pathways in Multicomponent alloys*, Deschamps A. Nat. Mater., 5:482 (2006).
Fuller et al., *Nucleation of Al3Zr and Al3Sc in aluminum alloys: From kinetic Monte Carlo simulations to classical theory*, Acta Mater., 53:5401 (2005).
Fuller et al.,*Temporal evolution of the nanostructure of Al(Sc,Zr) alloys: Part I—Chemical compositions of Al3(Sc1xZrx)precipitates*, Acta Mater., 53:5415 (2005).
Clouet et al., *An Atomic and Mesoscopic Study of Precipitation Kinetics in Al—Zr—Sc Alloys*, Adv. Eng. Mater., 8:1228 (2006).
Clouet et al., *Precipitation in Al—Zr—Sc Alloys: A comparison between kinetic Monte Carlo, cluster dynamics and classical nucleation theory*, Solid-solid phase transformations in inorganic materials, p. 1 (2005).
Lefebvre et al., *Precipitation kinetic of Al3(Sc,Zr) dispersoids in aluminium*, Marthinsen K. J. Alloys Compd., 470:107 (2009).
Clouet et al., *Precipitation kinetics of Al3Zr and Al3Sc in aluminum alloys modeled with cluster dynamics*, Acta Mater., 53:2313 (2005).
Hallem et al., *The formation of Al3(ScxZryHfl—x—y)-dispersoids in aluminium alloys*, Mater. Sci. Eng., A421:154 (2006).
Karnesky et al., *Evolution of nanoscale precipitates in Al microalloyed with Sc and Er*, Acta Mater., 57:4022 (2009).
Karnesky et al., *Creep of Al—Sc Microalloys with Rare-Earth Element Additions*, Mater. Sci. Forum, 519-521:1035 (2006).
Karnesky et al., *Effects of substituting rare-earth elements for scandium in a precipitation-strengthened Al-0.08 at. %Sc alloy*, Scr. Mater., 55:437 (2006).
Krug et al., *Core-shell nanoscale precipitates in Al-0.06 at.% Sc microalloyed with Tb, Ho, Tm, Lu*, Acta Mater., 58:134 (2009).
Van Dalen et al., *Erbium and ytterbium solubilities and diffusivities in aluminum as determined by nanoscale characterization of precipitates*, Acta Mater., 57:4081 (2009).
Harada et al., *Microstructure of Al3Sc with ternary rare-earth additions*, Intermetallics, 17:17 (2008).
Zalutskaya et al., РЕНТГЕ ПОТРІЙНИХ СПЛАВІВ ІНІЮ З РІДКІС АЛЮМ НОЗЕМЕ ДОСЛІД ЖЕННЯ БАГАТИХ НА AL НОСТРУ КТУРНЕ ЛЬНИМИ МЕТА ЛАМИ ІТРІЄВОЇ ПІДГ РУПИ І СКАН ДІЄМ Ser. A 31:255 (1969).
Marquis et al., *Model for creep threshold stress in precipitation-strengthened alloys with coherent particles*, Scr. Mater., 47:503 (2002).
Knipling et al., *Ambient- and high-temperature mechanical properties of isochronally aged Al-0.06Sc, Al-0.06Zr and Al-0.06Sc-0.06Zr*, Acta Mater., 59:943 (2011).
Knipling et al., *Precipitation evolution in Al-0.1Sc, Al-0.1Zr and Al-0.1Sc0.1Zr (at. %) alloys during isochronal aging*, Acta Mater., 58:5184 (2010).
Fuller et al., *Creep Properties of Coarse-Grained Al(Sc) Alloys At 300° C.*, Scr. Mater., 40:691 (1999).
Fuller et al., *Mechanical properties of Al(Sc,Zr) alloys at ambient and elevated temperatures*, Acta Mater., 51:4803 (2003).
Belov et al., *Optimization of hardening of Al—Zr—Sc cast alloys*, J. Mater. Sci., 41:5890 (2006).
Lohar et al., *Microstructural investigations on as-cast and annealed Al—Sc and Al—Sc—Zr alloys*, SC. Mater. Charact., 60:1387 (2009).
Smola et al., *Annealing effects in Al—Sc alloys*, Mater. Sci. Eng., A462:370 (2007).
Vlach et al., *Phase transformations in isochronally annealed mould-cast and cold-rolled Al—Sc—Zr-based alloy*, Alloys Comp., 492:143 (2009).
Davydov et al., *Alloying Aluminum Alloys with Scandium and Zirconium Additives*, Metalloved. Term. Obrab. Met., p. 25 (1996).
Hyland et al., *Homogeneous Nucleation Kinetics of Al3—Sc in a Dilute Al—Sc Alloy*, Metall. Trans., 23A:1947 (1992).
Van Dalen et al., *Effects of Yb and Zr microalloying additions on the microstructure and mechanical properties of dilute Al—Sc alloys*, Acta Mater., 59:7615 (2011).
Karnesky et al., "Effects of substituting rare-earth elements for scandium in a precipitation-strengthened Al-0.08at. %Sc alloy," Scripta Materialia, vol. 55, No. 5 (2006).
International Search Report and Written Opinion, PCT/US2013/026068 (2014).
Examination Report, EP 13 706 384.8-1362 (Aug. 26, 2015).
Official action issued by the Canadian Intellectual Property Office, CA 2,863,766 (Nov. 19, 2015).
Official action issued by the State Intellectual Property Office of China, CN 201380011518.9 (Dec. 3, 2015).
English translation of the official action issued by the State Intellectual Property Office of China, CN 201380011518.9 (Dec. 3, 2015).
Kawasaki et al., "Deformation of palladium plates by a small external stress during hydrogen absorption and desorption," *Materials Science and Engineering*, vol. 551, pp. 231-235 (2012).
Canadian Intellectual Property Office, Official Action, CA 2,863,766 (Jun. 29, 2016).

* cited by examiner

ALUMINUM ALLOY WITH ADDITIONS OF SCANDIUM, ZIRCONIUM AND ERBIUM

FIELD

The present application relates to aluminum alloys and, more particularly, to aluminum alloys with additions of scandium, zirconium, erbium and, optionally, silicon.

BACKGROUND

Cast iron and titanium alloys are currently the materials of choice for certain high-temperature applications, such as automotive chassis and transmission components, automotive and aircraft engine components, aircraft engine structural components and airframe structural skins and frames. However, cast dilute aluminum-zirconium-scandium (Al—Zr—Sc) alloys, where scandium and zirconium are below their solubility limits, are excellent alternatives to cast iron and titanium alloys in high temperature applications.

Aluminum-zirconium-scandium alloys offer promising strength and creep resistance at temperatures in excess of 300° C. Aluminum-zirconium-scandium alloys can be affordably produced using conventional casting and heat treatment. Upon aging, supersaturated aluminum-scandium alloys form coherent $L1_2$-ordered $Al_3Sc$ precipitates, which provide significant strengthening to a temperature of about 300° C. Zirconium is added to aluminum-scandium alloys to form coarsening-resistant $Al_3(Sc_xZr_{1-x})$ ($L1_2$) precipitates, which consist of a scandium-enriched core surrounded by a zirconium-enriched shell. Unfortunately, the high cost of scandium limits the industrial applicability of aluminum-scandium alloys.

Accordingly, those skilled in the art continue with research and development efforts in the field of aluminum alloys.

SUMMARY

In one aspect, disclosed is an alloy including aluminum with additions of scandium, zirconium, erbium and, optionally, silicon.

In another aspect, disclosed is an alloy that consists essentially of aluminum, scandium, zirconium, erbium and, optionally, silicon.

In another aspect, disclosed is an alloy including at most about 0.1 atomic percent ("at. %") (all concentrations herein are given in atomic percent unless otherwise indicated) scandium, at most about 0.1 at. % zirconium, at most about 0.05 at. % erbium, from about 0 to about 0.1 at. % silicon, and the balance aluminum.

In another aspect, disclosed is an alloy including at most about 0.08 at. % scandium, at most about 0.08 at. % zirconium, at most about 0.04 at. % erbium, from about 0 to about 0.08 at. % silicon, and the balance aluminum.

In another aspect, disclosed is an alloy including at most about 0.06 at. % scandium, at most about 0.06 at. % zirconium, at most about 0.02 at. % erbium, from about 0 to about 0.04 at. % silicon, and the balance aluminum.

In yet another aspect, disclosed is a method for forming an aluminum alloy. The method may include the steps of (1) creating a melt of aluminum including additions of scandium, zirconium, erbium and, optionally, silicon; (2) cooling the melt to room temperature to form a solid mass; (3) optionally homogenizing the solid mass at a temperature ranging from about 600 to about 660° C. (e.g., 650° C.) for about 1 to about 20 hours; (4) during a first heat treating step, maintaining the solid mass at a temperature ranging from about 275 to about 325° C. for about 2 to about 8 hours; and (5) after the first heat treating step, maintaining the solid mass at a temperature ranging from about 375 to about 425° C. for about 4 to about 12 hours.

Other aspects of the disclosed aluminum alloy and method will become apparent from the following detailed description, the accompanying drawings and the appended claims.

DETAILED DESCRIPTION

Figure 1A:
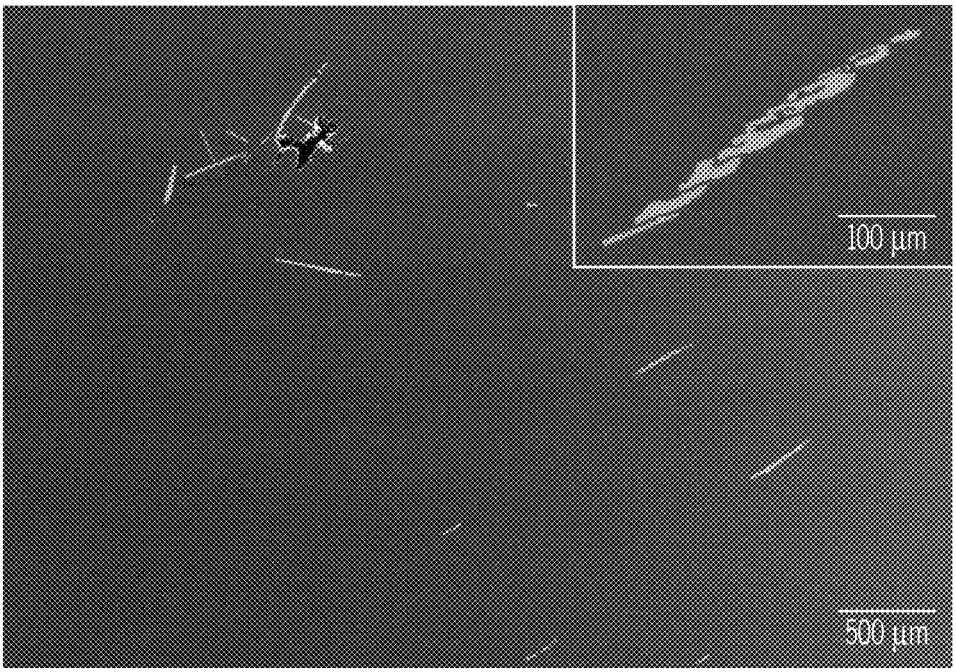
FIGS. 1A and 1B are scanning electron microscope ("SEM") micrographs of as-homogenized microstructures in Al-0.06 Zr-0.06 Sc (FIG. 1A) and Al-0.06 Zr-0.05 Sc-0.01 Er (FIG. 1B) (all compositions are given herein in atomic percent)

It has now been discovered that the substitution of some scandium with the lower-cost rare earth element erbium may be effective in maintaining high-temperature strength, and improving the creep resistance, of aluminum-scandium-zirconium alloys at temperatures as high as 400° C.

In a first aspect, the disclosed aluminum alloy may include aluminum with additions of scandium, zirconium and erbium.

In one particular implementation of the first aspect, the disclosed aluminum alloy may include at most about 0.1 at. % scandium, at most about 0.1 at. % zirconium and at most about 0.05 at. % erbium, with the balance of the alloy being substantially aluminum.

In another particular implementation of the first aspect, the disclosed aluminum alloy may include at most about 0.08 at. % scandium, at most about 0.08 at. % zirconium and at most about 0.04 at. % erbium, with the balance of the alloy being substantially aluminum.

In yet another particular implementation of the first aspect, the disclosed aluminum alloy may include at most about 0.06 at. % scandium, at most about 0.06 at. % zirconium and at most about 0.02 at. % erbium, with the balance of the alloy being substantially aluminum.

Those skilled in the art will appreciate that the disclosed aluminum alloys may include trace amounts of impurities, such as iron and silicon, without departing from the scope of the present disclosure. For example, iron and silicon may be present in the disclosed aluminum alloys in amounts below 0.0025 and 0.005 at. %, respectively.

Without being limited to any particular theory, it is believed that the addition of scandium to aluminum leads to the precipitation of a strengthening $Al_3Sc$ phase in the form of numerous coherent precipitates. The $Al_3Sc$ phase is rendered coarsening resistant by the addition of zirconium, which precipitates to form an $Al_3(Sc,Zr)$ outer shell on the $Al_3Sc$ precipitate core. The addition of erbium substitutes for some of the scandium in the precipitate, while also increasing the precipitate's lattice parameter mismatch with the aluminum matrix, thereby improving creep properties at high temperatures.

It has also been discovered that the presence of silicon in the disclosed aluminum alloy may accelerate the precipitation kinetics of scandium. Therefore, silicon may be intentionally added to the disclosed aluminum alloy to minimize the amount of heat treating, and hence energy cost and use of furnaces, required to achieve peak strength from $Al_3Sc$ ($L1_2$) precipitates.

Therefore, in another aspect, the disclosed aluminum alloy may include aluminum with additions of scandium, zirconium, erbium and silicon.

In one particular implementation of the second aspect, the disclosed aluminum alloy may include at most about 0.1 at. % scandium, at most about 0.1 at. % zirconium, at most about 0.05 at. % erbium and at most about 0.1 at. % silicon, with the balance of the alloy being substantially aluminum.

In another particular implementation of the second aspect, the disclosed aluminum alloy may include at most about 0.08 at. % scandium, at most about 0.08 at. % zirconium, at most about 0.04 at. % erbium and at most about 0.08 at. % silicon, with the balance of the alloy being substantially aluminum.

In yet another particular implementation of the second aspect, the disclosed aluminum alloy may include at most about 0.06 at. % scandium, at most about 0.06 at. % zirconium, at most about 0.02 at. % erbium and at most about 0.04 at. % silicon, with the balance of the alloy being substantially aluminum.

EXAMPLES

Alloys 1-3

Alloy Compositions and Processing

A ternary and two quaternary alloys were cast with nominal compositions, in atomic percent ("at. %"), of Al-0.06 Zr-0.06 Sc ("Alloy 1") (comparative example), Al-0.06 Zr-0.05 Sc-0.01 Er ("Alloy 2") and Al-0.06 Zr-0.04 Sc-0.02 Er ("Alloy 3"). The compositions of Alloys 1-3 in the as-cast state, as measured by direct current plasma emission spectroscopy ("DCPMS") (ATI Wah Chang, Albany, Oreg.) and 3-D local-electrode atom-probe ("LEAP") tomography, are provided in Table 1. The silicon and iron content of the alloys was less than the 0.005 and 0.0025 at. % detection limits, respectively, of the DCPMS technique.

TABLE 1

| | Measured Composition (DCPMS) | | | Measured Composition (3-D LEAP) | | |
|---|---|---|---|---|---|---|
| Alloy | Zr | Sc | Er | Zr | Sc | Er |
| 1 | 0.052 | 0.067 | — | 0.0256 | 0.0685 | — |
| 2 | 0.035 | 0.047 | 0.01 | 0.0198 | 0.0476 | 0.0038 |
| 3 | 0.035 | 0.042 | 0.019 | 0.02 | 0.0394 | 0.0046 |

The alloys were dilution cast from 99.999 at. % pure Al (Alfa Aesar, Ward Hill, Mass.) and Al-0.9 at. % Sc, Al-0.6 at. % Zr and Al-1.15 at. % Er master alloys. The Al—Sc and Al—Zr master alloys were themselves dilution cast from commercial Al-1.3 at. % Sc (Ashurst Technology, Ltd., Baltimore, Md.) and Al-3 at. % Zr (KB Alloys, Reading, Pa.) master alloys. The Al—Er master alloy was prepared by melting 99.999 at. % pure Al with 99.99 at. % Er (Stanford Materials Corporation, Aliso Viejo, Calif.) using non-consumable electrode arc-melting in a gettered purified-argon atmosphere (Atlantic Equipment Engineers, Bergenfield, N.J.). To create the final dilute alloys, the master alloys and 99.999 at. % pure Al were melted in flowing argon in zirconia-coated alumina crucibles in a resistively heated furnace at 850° C. The master alloys were preheated to 640° C. to accelerate solute dissolution and minimize solute losses from the melt. The melt was held in a resistively heated furnace for 7 min at 850° C., stirred vigorously, and then cast into a graphite mold preheated to 200° C. During solidification, the mold was chilled by placing it on an ice-cooled copper platen to encourage directional solidification and discourage the formation of shrinkage cavities.

The castings were homogenized in air at 640° C. for 72 h and then water quenched to ambient temperature.

Three separate aging studies were conducted: (i) isochronal aging in stages of 25° C. $h^{-1}$ for temperatures from 100 to 600° C.; (ii) isothermal aging at 400° C. for times ranging from 0.5 min to 256 days (8 months); and (iii) two-stage isothermal aging consisting of a first heat treatment at 300° C. for 24 h followed by aging at 400° C. for times ranging from 0.5 h to 64 days. Molten salt ($NaNO_2$—$NaNO_3$—$KNO_3$) baths were used for aging durations less than 0.5 h to ensure rapid heat transfer, while longer aging experiments were performed in air.

Analytical Techniques

The homogenized microstructure of unetched samples polished to a 1 μm surface finish was imaged by SEM using a Hitachi S3400N-II microscope, equipped with an Oxford Instruments INCAx-act detector for energy-dispersive X-ray spectroscopy (EDS). The precipitate morphology was studied using a Hitachi 8100 transmission electron microscope at 200 kV. TEM foils were prepared by grinding aged specimens to a thickness of 100-200 μm, from which 3 mm diameter disks were punched. These disks were thinned by twin-jet electropolishing at about 20 V DC using a Struers TenuPol-5 with a 10 vol. % solution of perchloric acid in methanol at −40° C.

Precipitation in these alloys was monitored by Vickers microhardness and electrical conductivity measurements. Vickers microhardness measurements were performed on a Duramin-5 microhardness tester (Struers) using a 200 g load applied for 5 s on samples polished to a 1 μm surface finish. Fifteen indentations were made per specimen across several grains. Electrical conductivity measurements were performed using a Sigmatest 2.069 eddy current instrument (Foerster Instruments, Pittsburgh, Pa.) at frequencies of 120, 240, 480 and 960 kHz.

Specimens for three-dimensional local-electrode atom-probe (3-D LEAP) tomography were prepared by cutting blanks with a diamond saw to approximate dimensions of 0.35 by 0.35 by 10 $mm^3$. These were electropolished at 8-20 V DC using a solution of 10% perchloric acid in acetic acid, followed by a solution of 2% perchloric acid in butoxyethanol at room temperature. Pulsed-laser 3-D atom-probe tomography was performed with a LEAP 4000X Si X tomograph (Cameca, Madison, Wis.) at a specimen temperature of 35 K, employing focused picosecond UV laser pulses (wavelength=355 nm) with a laser beam waist of less than 5 mm at the $e^{-2}$ diameter. A laser energy of 0.075 nJ per pulse, a pulse repetition rate of 250 kHz, and an evaporation rate of 0.04 ions per pulse were used. 3-D LEAP tomographic data were analyzed with the software program IVAS 3.4.1 (Cameca). The matrix/precipitate heterophase interfaces were delineated with Sc isoconcentration surfaces, and compositional information was obtained with the proximity histogram methodology. The measurement errors for all quantities were calculated based on counting statistics and standard error propagation techniques.

As-Homogenized Microstructural Analysis

The homogenized microstructure of the alloys consists of columnar grains with diameters of the order of 1-2 mm. SEM shows the presence of intragranular $Al_3Zr$ flakes in all alloys, which are retained from the melt due to incomplete dissolution of the Al—Zr master alloy (FIG. 1A). The approximate composition of the flakes was obtained by semi-quantitative EDS, i.e. without rigorous calibration, which confirms the $Al_3Zr$ stoichiometry, and reveals neither Er nor Sc in the flakes. The differences between the nominal and measured Zr concentrations of the alloys in Table 1 are believed to be a result of these Zr-rich flakes, which are not uniformly distributed in the alloys, and may have been excluded from the 300 $mm^3$ of material used for DCPMS. No $Al_3Zr$ flakes were present in the small analysis volume of the 3-D LEAP tomographic reconstructions, and therefore the average of the measured Zr concentrations from the 3-D LEAP tomographic datasets of each alloy (Table 1) shows the Zr available in the matrix for precipitation during aging.

Figure 1B:
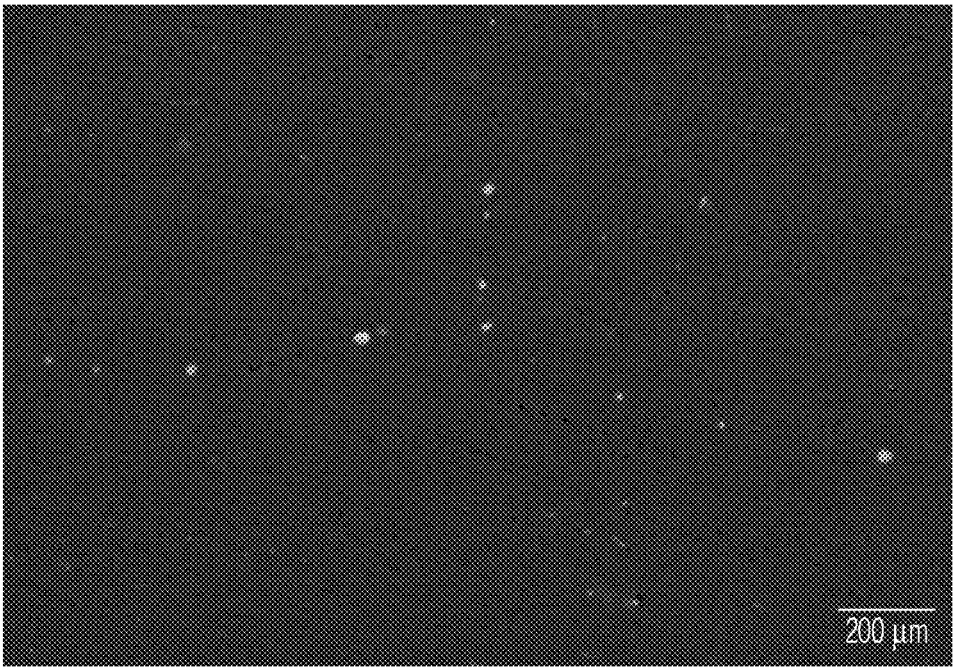

In the Er-containing alloys, intergranular $Al_3Er$ ($L1_2$) primary precipitates were detected, and contained neither Zr nor Sc, as confirmed by EDS (FIG. 1B). Primary precipitation in these alloys decreases strength by depleting the matrix of solute and, when excessive, can result in grain refinement, reducing the resistance to diffusional creep. The formation of primary precipitates in the homogenized samples indicates that the Er-containing alloys exceeded their solubility limit during solidification and homogenization. The addition of Sc and Zr has thus decreased the 0.046 at. % solubility of Er in binary Al—Er. The analysis volume of the 3-D LEAP tomography technique is too small to detect intergranular $Al_3Er$, as was the case for the $Al_3Zr$ flakes. The 3-D LEAP-tomographic measured compositions of Er of 0.0046±0.0004 and 0.0038±0.0004 at. % for Al-0.06 Zr-0.04 Sc-0.02 Er and Al-0.06 Zr-0.05 Sc-0.01 Er, are well below the nominal values of 0.02 and 0.01 at. % Er, respectively (Table 1). Only a fraction of the Er added to the alloys is available for nanoscale precipitation.

Previous research on arc-melted Al-0.06 Zr-0.06 Sc and Al-0.1 Zr-0.1 Sc at. % alloys revealed microsegregation of both Sc and Zr in the as-cast condition using linear composition profiles obtained employing quantitative electron-probe microanalysis (EPMA). The first solid to form in dilute Al—Zr—Sc alloys is enriched in Zr, resulting in a microstructure consisting of Zr-enriched dendrites surrounded by Sc-enriched interdendritic regions. The as-cast Al-0.06 Zr-0.06 Sc at. % alloy in the previous work showed a Zr enrichment of about 0.04 at. % Zr and a Sc depletion of about 0.01 at. % in the dendrites with respect to the average alloy composition, while the interdendritic region was depleted by about 0.04 at. % Zr and enriched by about 0.02 at. % Sc. Microsegregation is expected in the present alloys, though to a lesser extent than in the previous Al-0.06 Zr-0.06 Sc and Al-0.1 Zr-0.1 Sc alloys, because the incomplete dissolution of the Al—Zr master alloy diminishes the effective Zr alloy concentration to 0.02-0.03 at. % (Table 1).

The degree of solute microsegregation in the present research is also diminished by homogenization at 640° C. for 72 h, which was not performed in prior work on Al-0.06 Zr-0.06 Sc due to concerns about primary precipitation of $Al_3Zr$. In a similar study on Al-0.06 Sc, the microsegregation of Sc was completely eliminated by homogenization at 640° C. for 28 h. Given that the diffusivity of Zr in Al, $1.0\times10^{-15}$ $m^2$ $s^{-1}$, is significantly smaller than that of Sc in Al, $6.7\times10^{-14}$ $m^2$ $s^{-1}$, at 640° C., homogenization of Zr requires heat-treatment durations that are impractically long.

In summary, the effective Zr and Er concentrations of the alloys are believed to be smaller than their nominal values due to incomplete dissolution of the Al—Zr master alloy, and the formation of intergranular primary $Al_3Er$ ($L1_2$) precipitates. For simplicity, the nominal compositions are used herein to label the alloys.

Isochronal Aging

Figure 2A:
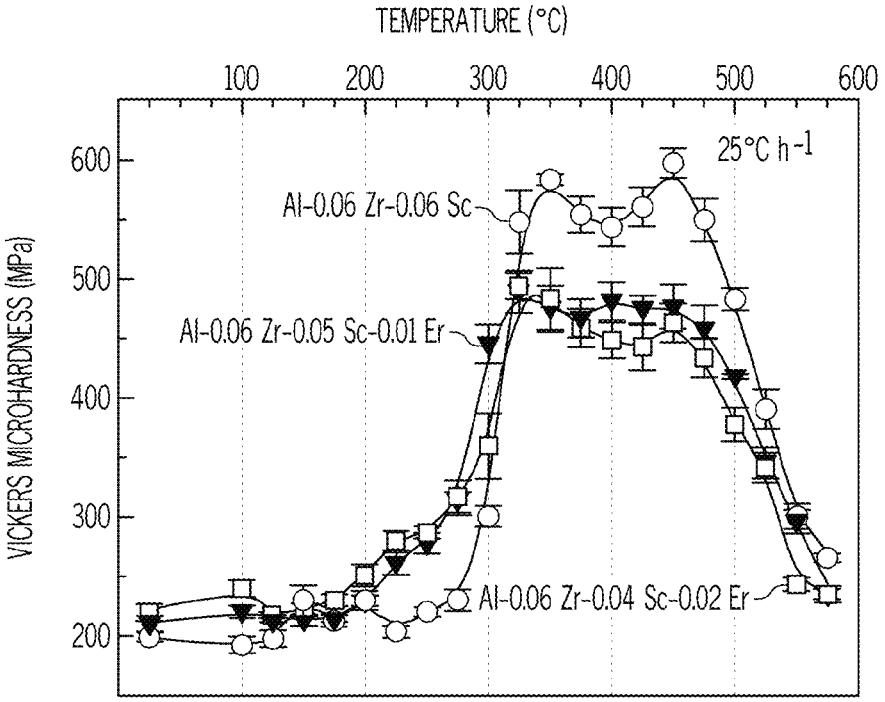
FIGS. 2A and 2B are graphical illustrations of the evolution of the Vickers microhardness (FIG. 2A) and electrical conductivity (FIG. 2B) during isochronal aging in stages of 25° C. $h^{-1}$ for Al-0.06 Zr-0.06 Sc, Al-0.06 Zr-0.05 Sc-0.01 Er and Al-0.06 Zr-0.04 Sc-0.02 Er.
Figure 2B:
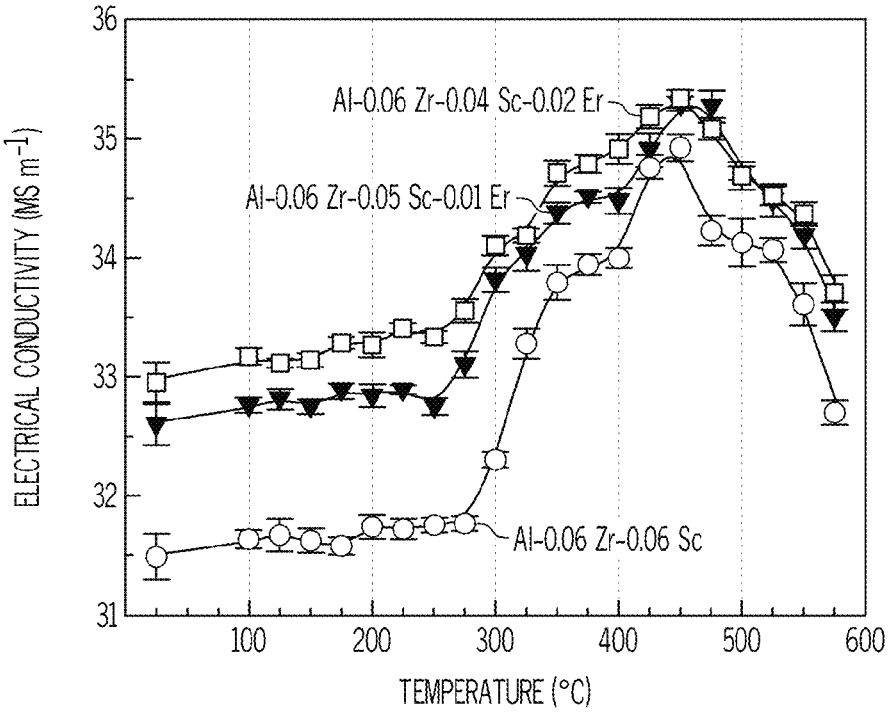

The precipitation behavior of Alloys 1-3 during isochronal aging in stages of 25° C. $h^{-1}$ is shown in FIG. 2, as monitored by Vickers microhardness and electrical conductivity. In Alloy 1 (Al-0.06 Zr-0.06 Sc), precipitation commences at 300° C., as reflected by a sharp increase in the microhardness and electrical conductivity. The microhardness peaks for the first time at 350° C. and achieves a value of 582±5 MPa, before decreasing to 543±16 MPa at 400° C. The microhardness increases again at 425° C., achieving a second peak of 597±16 MPa at 450° C. The electrical conductivity increases continuously from 300 to 375° C., before reaching a plateau at values of 33.94±0.09 and 33.99±0.09 MS $m^{-1}$ for 375 and 400° C. At 425° C., the electrical conductivity increases to 34.75±0.10 MS $m^{-1}$, reaching a peak of 34.92±0.11 MS $m^{-1}$ at 450° C. Above 450° C., both microhardness and electrical conductivity decrease quickly due to precipitate dissolution.

The first peak in the microhardness of Alloy 1 at 325° C. occurs at the same temperature as the peak microhardness in recent studies of Al-0.06 Sc and Al-0.1 Sc alloys aged isochronally for 3 h for every 25° C. increase. As such, the first peak in the microhardness we observe can be attributed to the precipitation of $Al_3Sc$. The second peak in the microhardness at 450° C. occurs at the same temperature as was previously found to produce a peak in the microhardness of an Al-0.1 Zr alloy aged isochronally for 3 h for every 25° C. increase. The peak microhardness in an Al-0.06 Zr alloy was found to occur at 475° C. for samples aged isochronally for 3 h for every 25° C. increase. The second peak in the microhardness is thus due to precipitation of Zr from the matrix. Previously studied Al-0.06 Zr-0.06 Sc and Al-0.1 Zr-0.1 Sc alloys aged isochronally for 3 h for every 25° C. increase were found to have only one peak in the microhardness, occurring at 400° C. The detection of only one peak in the microhardness was probably due to the smaller temporal resolution used in the previous studies, compared to the isochronal aging of 1 h for every 25° C. employed for Alloys 1-3.

The peak microhardness of the Er-containing alloys ("Alloys 2 and 3") is smaller than that observed in Alloy 1. These results are consistent with isochronal microhardness results from Al-0.12 Sc and Al-0.9 Sc-0.03 Er alloys, where it was reasoned that the decrease in strength with the addition of Er was a result of solute consumption by primary precipitates, such as those in FIG. 1A. Nanoscale precipitation in the Er-containing alloys, as evidenced by increases in microhardness and conductivity, begins at temperatures as low as 200° C. The microhardness values of the Er-containing alloys achieve a plateau between 325 and 450° C. Beyond 450° C., both microhardness and electrical conductivity decrease rapidly due to precipitate dissolution, as observed in Al-0.06 Zr-0.06 Sc. The electrical conductivity of homogenized Al-0.06 Zr-0.06 Sc of 31.5±0.2 MS $m^{-1}$ is significantly smaller than the values of 32.6±0.2 and 33.0±0.2 MS $m^{-1}$ for Al-0.06 Zr-0.05 Sc-0.01 Er (Alloy 2) and Al-0.06 Zr-0.04 Sc-0.02 Er (Alloy 3), respectively. This is a result of primary precipitation of $Al_3Er$ ($L1_2$) in the Er-containing alloys, which deprives the matrix of solute and increases the electrical conductivity.

Figure 3A:
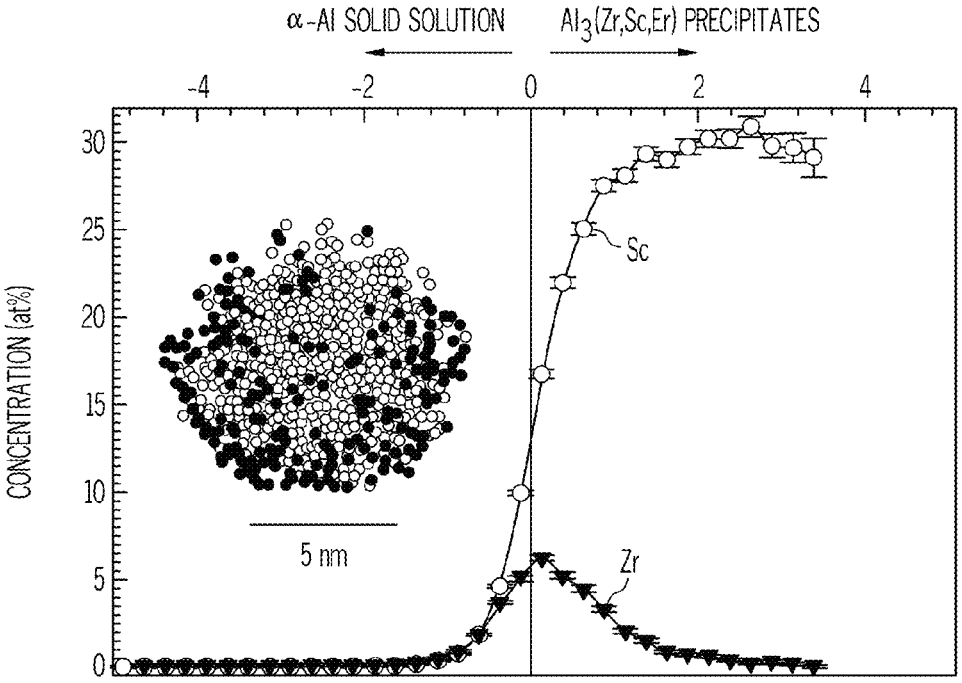
FIGS. 3A and 3B are graphical illustrations of concentration profiles across the matrix/precipitate interface following isochronal aging to 450° C. in stages of 25° C. $h^{-1}$ for Al-0.06 Zr-0.06 Sc (FIG. 3A) and Al-0.06 Zr-0.04 Sc-0.02 Er (FIG. 3B), which were obtained using 3-D atom-probe tomography ("APT")
Figure 3B:
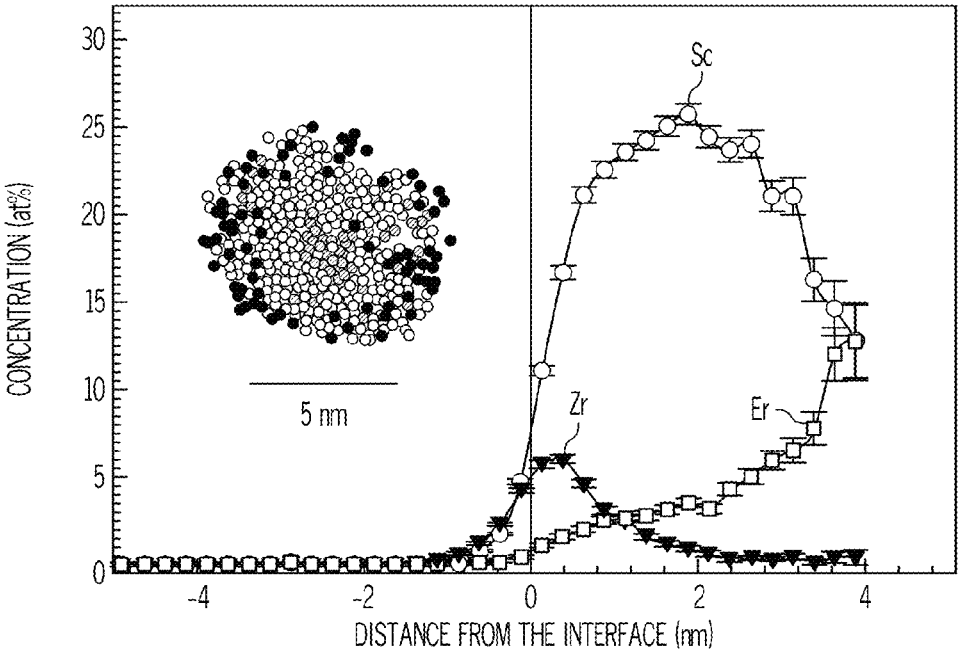

The nanostructures of Al-0.06 Zr-0.06 Sc and Al-0.06 Zr-0.04 Sc-0.02 Er aged isochronally to peak strength at 450° C., and obtained from 3-D LEAP tomography. The Al-0.06 Zr-0.06 Sc alloy, has a number density of precipitates, $N_v$, of $2.1\pm0.2\times10^{22}$ $m^{-3}$, with an average radius, <R>, of 3.1±0.4 nm, and a volume fraction, $\phi$, of 0.251±0.002%. The number density in Al-0.06 Zr-0.04 Sc-0.02 Er is smaller, $8.6\pm1.5\times10^{21}$ $m^{-3}$, with average radius and volume fraction values of 3.4±0.6 nm and 0.157±0.003%, respectively. The number density and volume fraction of precipitates are smaller in the Er-containing alloy because the matrix solute supersaturation is smaller due to primary precipitation of Er during solidification and homogenization (FIG. 1). The concentration profiles across the matrix/precipitate interface obtained from the 3-D LEAP tomographic results are displayed in FIG. 3. As anticipated, the precipitates in Al-0.06 Zr-0.06 Sc consist of a Sc-enriched core surrounded by a Zr-enriched shell, with an average precipitate composition of 71.95±0.10 at. % Al, 5.42±0.05 at. % Zr and 22.63±0.09 at. % Sc. The precipitates in Al-0.06 Zr-0.04 Sc-0.02 Er consist of an Er-enriched core surrounded by a Sc-enriched inner shell and a Zr-enriched outer shell, with an average precipitate composition of 73.27±0.15 at. % Al, 5.01±0.07 at. % Zr, 18.96±0.13 at. % Sc and 2.75±0.05 at. % Er.

Isothermal Aging at 400° C.

Figure 4A:
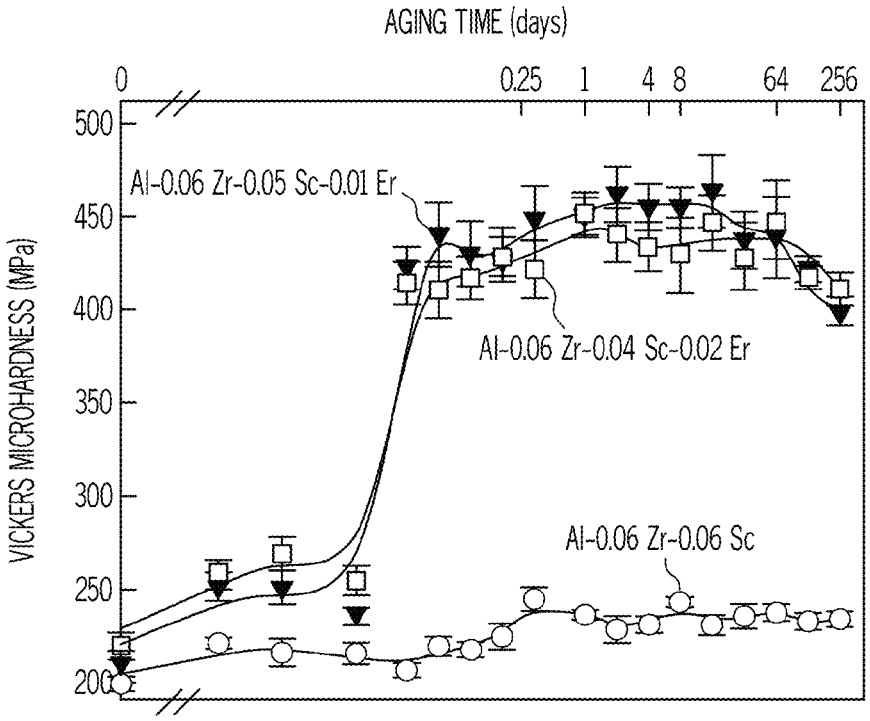
FIGS. 4A and 4B are graphical illustrations of the evolution of the Vickers microhardness (FIG. 4A) and electrical conductivity (FIG. 4B) during isothermal aging at 400° C. for Al-0.06 Zr-0.06 Sc, Al-0.06 Zr-0.05 Sc-0.01 Er and Al-0.06 Zr-0.04 Sc-0.02 Er.
Figure 4B:
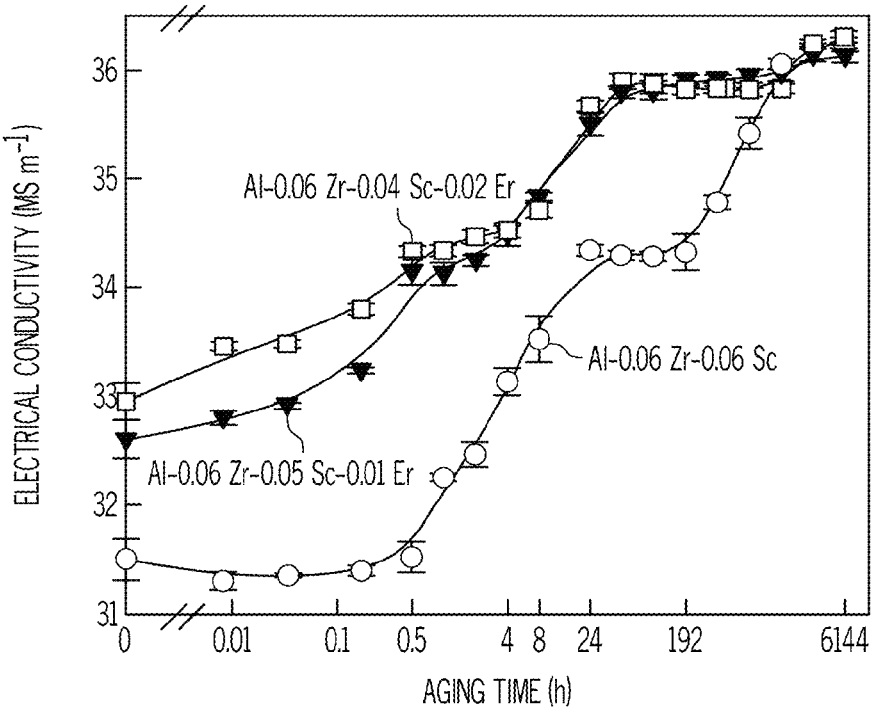

The precipitation behavior of the alloys during isothermal aging at 400° C. for aging times from 0.5 min to 256 days, as monitored by Vickers microhardness and electrical conductivity, is displayed in FIG. 4. The Vickers microhardness of Alloy 1 (Al-0.06 Zr-0.06 Sc) does not increase significantly over the full range of aging times, which is surprising given the strengths achieved by isochronal aging (see FIG. 2). The electrical conductivity of Alloy 1 remains unchanged over the first 0.5 h of aging at 400° C., before increasing steadily over the subsequent 64 days. Small strengths in dilute Al—Sc alloys with Sc concentrations of 0.06-0.07 at. % have been observed previously to be a result of inadequate solute supersaturation, resulting in a small number density of larger precipitates, which do not strengthen the material significantly. The precipitates, which have large radii, of the order of 50 nm, have a non-equilibrium lobed-cuboidal morphology. This morphology is believed to be due to growth instabilities that accommodate the anisotropy of the elastic constants of the matrix and the precipitates.

The microhardness values of the two Er-containing alloys, Alloys 2 and 3, during isothermal aging at 400° C. are comparable over the full range of aging times. Both alloys exhibit a microhardness increase after 0.5 min, with a concomitant increase in the electrical conductivity. After 0.5 h of aging, the microhardness values of Alloys 1 and 2 are 422±12 and 414±11 MPa, respectively. This is in dramatic contrast to the Er-free alloy (Alloy 1), whose microhardness does not increase beyond the homogenized value of 199±14 MPa after 0.5 h, and achieves a peak microhardness of only 243±3 MPa after 8 days at 400° C. By contrast, the microhardness of Alloy 2 peaks at a value of 461±15 MPa after 2 days, and diminishes slightly to 438±21 MPa after 64 days of aging at 400° C. Alloy 3 has a maximum microhardness of 451±11 MPa after 1 day of aging, and has the same microhardness, within uncertainty, of 448±21 MPa after 64 days at 400° C. The microhardness values of Alloys 2 and 3 decrease for aging times of 128 and 256 days due to precipitate coarsening. The electrical conductivities of Alloys 2 and 3 increase steadily over the first 1-2 days, as precipitation proceeds. Between 2 and 64 days, the electrical conductivities of both alloys achieve plateaus, indicating that the majority of the available solute has precipitated out of solution. The electrical conductivities of Alloys 2 and 3 increase slightly after 128 and 256 days of aging, as the alloys continue to slowly approach equilibrium.

Figure 5A:
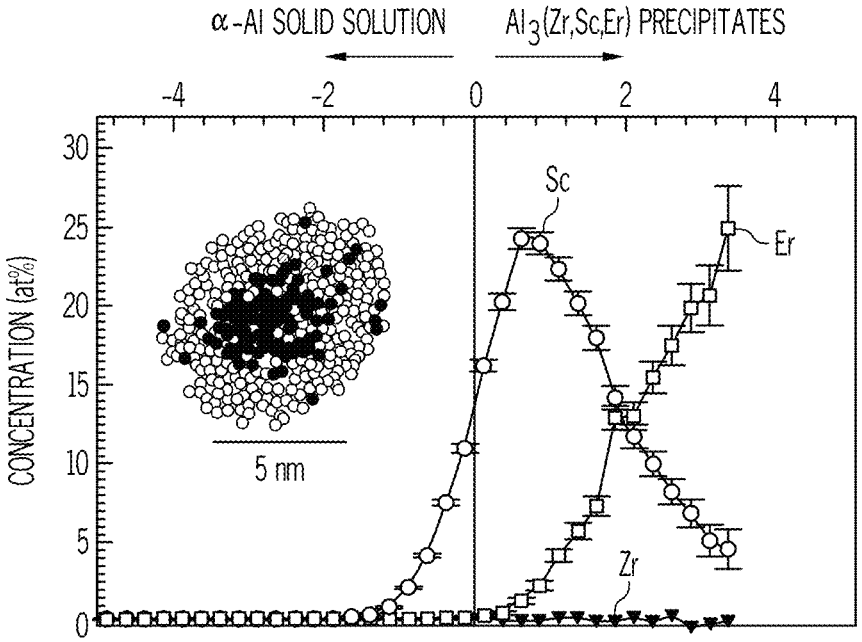
FIGS. 5A and 5B are graphical illustrations of concentration profiles across the matrix/precipitate interface for Al-0.06 Zr-0.04 Sc-0.02 Er samples aged isothermally at 400° C. for 0.5 h (FIG. 5A) and 64 days (FIG. 5B), which were obtained using 3-D APT.
Figure 5B:
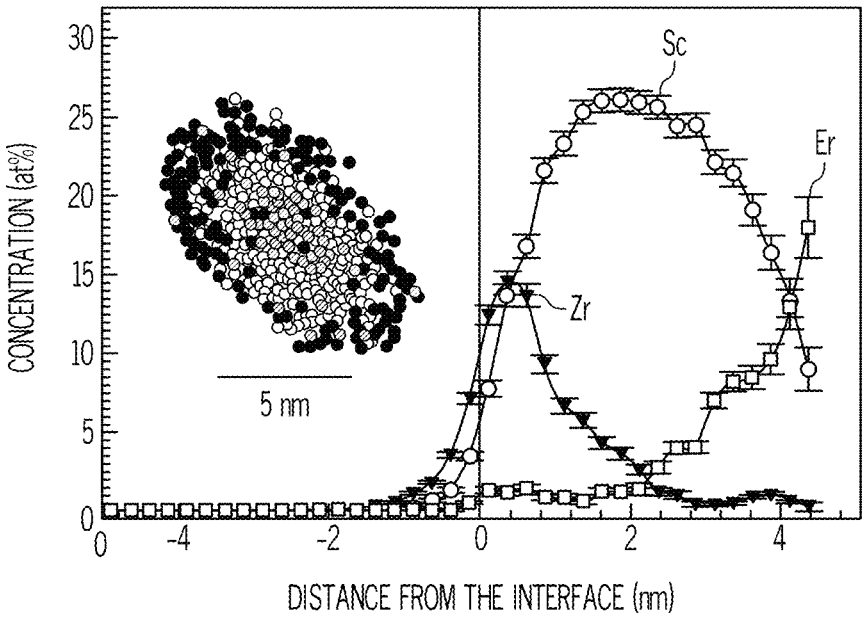

The nanostructures of Alloy 3 aged isothermally for 0.5 h and 64 days at 400° C. were compared employing 3-D LEAP tomography. From the 3-D LEAP tomographic images, and the associated concentration profiles (FIG. 5), it is clear that the precipitates consist of an Er-enriched core surrounded by a Sc-enriched shell after 0.5 h of aging. After 0.5 h of aging, Alloy 3 has a number density of precipitates of $5.4\pm1.7\times10^{21}$ $m^{-3}$, with an average radius of 3.7±0.3 nm, and a volume fraction of 0.144±0.006%. The number density of $6.1\pm1.9\times10^{21}$ $m^{-3}$ and the radius of 3.8±0.4 nm are unchanged, within uncertainty, after 64 days at 400° C., although the volume fraction increases to 0.207±0.007%.

After 0.5 h of aging at 400° C., the precipitates in Alloy 3 consist of an Er-enriched core surrounded by a Sc-enriched shell structure with an average precipitate composition of 73.02±0.20 at. % Al, 0.64±0.04 at. % Zr, 22.25±0.19 at. % Sc and 4.08±0.09 at. % Er at. %. The average precipitate composition after 64 days at 400° C., 70.46±0.22 at. % Al, 6.55±0.12 at. % Zr, 19.75±0.19 at. % Sc, 3.24±0.09 at. % Er, reflects the precipitation of the Zr-enriched outer shell, which renders the precipitates coarsening resistant. The matrix is depleted of Sc and Zr as precipitation proceeds, as evidenced by decreases in the Zr concentration from 167±14 to 35±15 at. ppm, and in Sc from 70±6 to 25±6 at. ppm between 0.5 h and 64 days.

The precipitation behavior of Alloys 1-3 exhibits three distinct stages of development at 400° C., as shown in FIG. 4. In the Er-containing alloys, a short incubation period of 0.5 min is followed by a rapid increase in the microhardness and electrical conductivity over the first hour, associated with the precipitation of Er and Sc, which is followed by a slower increase in conductivity due to the precipitation of Zr. In Alloy 1, the incubation period of 0.5 h is followed by a rapid increase in the electrical conductivity from 0.5 to 24 h as Sc precipitates from solution, followed by a slow second increase in the conductivity due to precipitation of Zr.

Two-Stage Isothermal Aging

A two-stage heat treatment was performed: (i) to improve the microhardness of Alloy 1 at 400° C.; and (ii) to optimize the nanostructure, and hence the microhardness, of Alloys 2 and 3.

The first stage of the heat treatment was performed at 300° C. for 24 h. The objective of this first stage is to precipitate the Er and Sc atoms from solid solution at a temperature as low as practical, maximizing the solute supersaturation, and hence the number density of precipitates. Zr is essentially immobile in Al at 300° C. over a period of 24 h, with a root-mean-square (RMS) diffusion distance of 1.5 nm, as compared to RMS diffusion distances of 56 and 372±186 nm for Sc and Er, respectively.

Figure 6A:
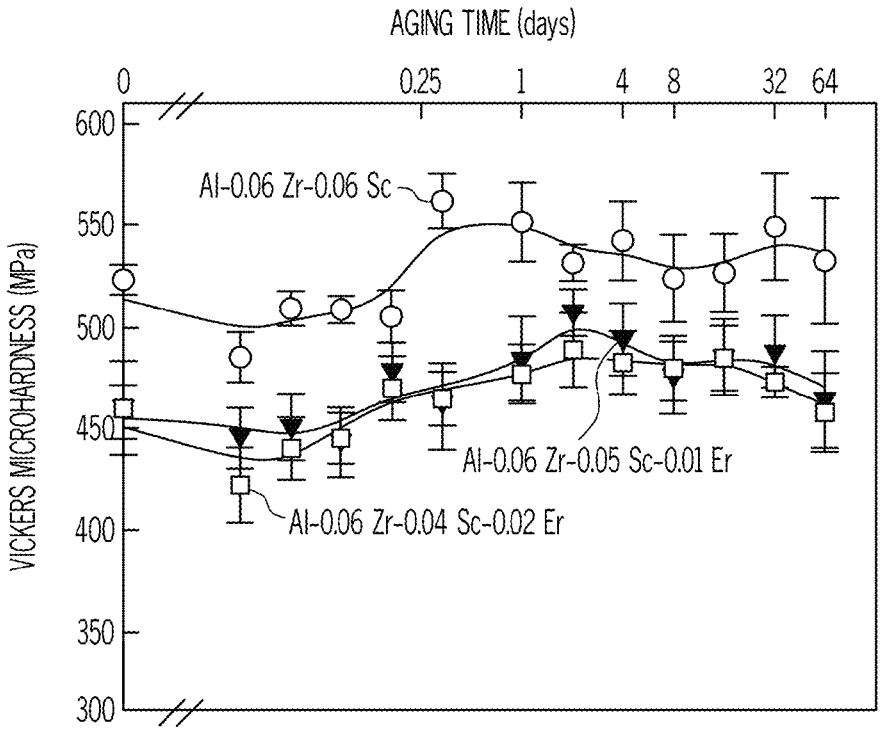
FIGS. 6A and 6B are graphical illustrations of the temporal evolution of the Vickers microhardness (FIG. 6A) and electrical conductivity (FIG. 6B) during isothermal aging at 400° C. for Al-0.06 Zr-0.06 Sc, Al-0.06 Zr-0.05 Sc-0.01 Er and Al-0.06 Zr-0.04 Sc-0.02 Er previously aged 24 hours at 300° C.
Figure 6B:
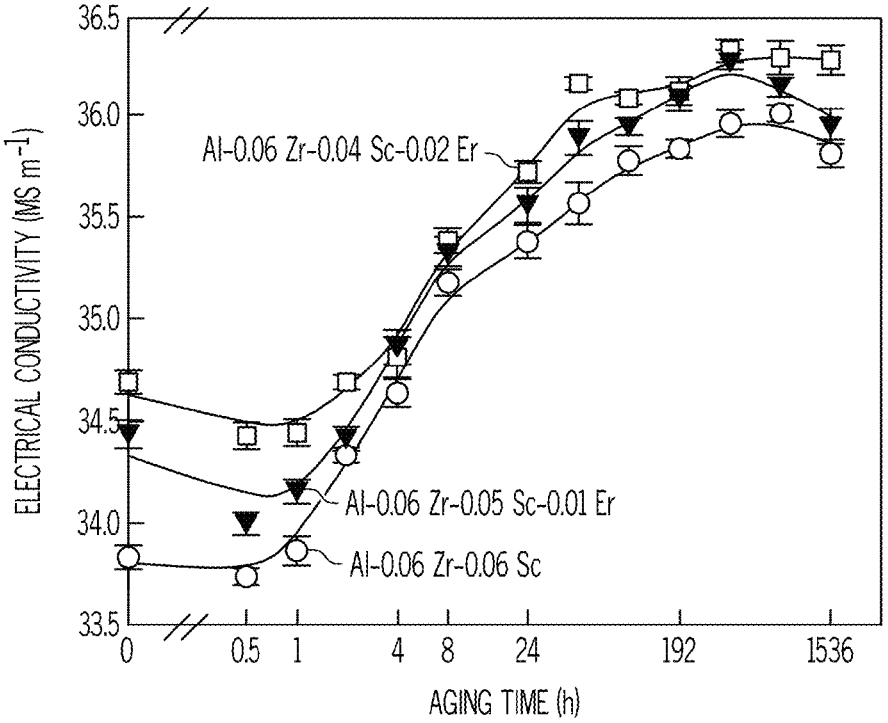

The second stage of the heat treatment, designed to precipitate Zr, was performed at 400° C. for aging times ranging from 0.5 h to 64 days. At 400° C., the Zr RMS diffusion distance after 24 h is 64 nm, comparable to the Sc RMS diffusion distance of 56 nm in 24 h at 300° C. The precipitation response during the second stage, as monitored by the Vickers microhardness and electrical conductivity, is shown in FIG. 6.

The microhardness of Alloy 1 following the two-stage 300/400° C. heat treatment (FIG. 6), is significantly improved compared to the values measured for the single isothermal aging at 400° C. (FIG. 4). After 24 h at 300° C., the microhardness of Alloy 1 is 523±7 MPa, compared to 236±3 MPa after 24 h at 400° C. (FIG. 4). The aging treatment at 300° C. provides sufficient solute supersaturation to precipitate a significant number density ($10^{21}$-$10^{22}$ $m^{-3}$), of spheroidal precipitates, such as those obtained during isochronal aging. Following a second heat treatment of 8 h at 400° C., the microhardness achieves a maximum value of 561±14 MPa, and decreases only slightly to 533±31 MPa after 64 days at 400° C.

The Er-containing alloys (Alloys 2 and 3) achieve peak microhardness after 8 h of aging at 400° C., with values of 507±11 and 489±11 MPa for Alloys 2 and 3, respectively. These peak values are larger than those achieved in single-stage isothermal aging at 400° C. (461±15 and 451±11 MPa). The Er-containing alloys (Alloys 2 and 3) that underwent two-stage aging experience only a slight decrease in microhardness after 64 days at 400° C., from 507±11 to 464±23 MPa for Alloy 2, and from 489±11 to 458±19 MPa for Alloy 3.

Thus, Zr and Er are effective replacements for Sc in Al—Sc systems, accounting for 33±1% of the total precipitate solute content in Al-0.06 Zr-0.04 Sc-0.02 Er aged at 400° C. for 64 days. The addition of Er to the Al—Sc—Zn system was found to result in the formation of coherent, spheroidal, $L1_2$-ordered precipitates with a nanostructure consisting of an Er-enriched core surrounded by a Sc-enriched inner shell and a Zr-enriched outer shell were formed. This core/double-shell structure is formed upon aging as solute elements precipitate sequentially according to their diffusivities, where $D_{Er}>D_{Sc}>D_{Zr}$. The core/double-shell structure remains coarsening resistant for at least 64 days at 400° C.

Alloys 4 and 5

Alloy Compositions and Processing

Two alloys were prepared with nominal compositions, in atomic percent ("at. %"), of Al-0.06 Zr-0.06 Sc-0.04 Si ("Alloy 4") (comparative example) and Al-0.06 Zr-(0.05 Sc-0.01 Er)-0.04 Si ("Alloy 5"). Alloys 4 and 5 were inductively-melted to a temperature of 900° C. from 99.99 at. % pure Al, 99.995 at. % Si, and Al-0.96 at. % Sc, Al-3 at. % Zr and Al-78 at. % Er master alloys. The two alloys were cast into a cast-iron mold preheated to 200° C. The compositions of Alloys 4 and 5 in the as-cast state, as measured using direct current plasma emission spectroscopy ("DCPMS") and three dimensional local-electrode atom-probe ("3-D LEAP") tomography are given in Table 2. The impurity iron content of Alloys 4 and 5 was 0.006 at. %.

TABLE 2

| | Measured Composition (DCPMS) | | | | Measured Composition (3-D LEAP) | | | |
|---|---|---|---|---|---|---|---|---|
| Alloy | Si | Zr | Sc | Er | Si | Zr | Sc | Er |
| 4 | 0.036 | 0.062 | 0.059 | — | 0.0211 | 0.0441 | 0.0583 | — |
| 5 | 0.033 | 0.056 | 0.046 | 0.011 | 0.0347 | 0.0412 | 0.0434 | 0.0044 |

The cast alloys were homogenized in air at 640° C. for 72 h and then water quenched to ambient temperature. A two-stage aging treatment of 4 h at 300° C. followed by 8 h at 425° C. was employed to achieve peak strength and coarsening resistance, as explained above. The second stage temperature of 425° C. was selected so that the final aging temperature was higher than the creep testing temperature of 400° C.

Microstructure Observations

The microstructures of samples polished to a 1 μm surface finish were imaged by SEM using a Hitachi S3400N-II microscope, equipped with an Oxford Instruments INCAx-act detector for energy-dispersive x-ray spectroscopy (EDS). Polished specimens were then etched for 30 s using Keller's reagent to reveal their grain boundaries. Vickers microhardness measurements were performed on a Duramin-5 microhardness tester (Struers) using a 200 g load applied for 5 s on samples polished to a 1 μm surface finish. Fifteen indentations were made per specimen across several grains.

Specimens for three-dimensional local-electrode atom-probe (3-D LEAP) tomography were prepared by cutting blanks with a diamond saw to dimensions of 0.35×0.35×10 $mm^3$. These were electropolished at 8-20 Vdc using a solution of 10% perchloric acid in acetic acid, followed by a solution of 2% perchloric acid in butoxyethanol at room temperature. Pulsed-voltage 3-D atom-probe tomography ("APT") was performed with a LEAP 4000X Si X tomograph (Cameca, Madison, Wis.) at a specimen temperature of 35 K, employing a pulse repetition rate of 250 kHz, a pulse fraction of 20%, and an evaporation rate of 0.04 ions per pulse. 3-D LEAP tomographic data were analyzed with the software program IVAS 3.4.1 (Cameca). The matrix/precipitate heterophase interfaces were delineated with Al isoconcentration surfaces, and compositional profiles were obtained with the proximity histogram (proxigram) methodology. The measurement errors for all quantities were calculated based on counting statistics and standard error propagation techniques.

Previous attempts to measure Si concentrations in Al by 3-D LEAP tomography have resulted in measured values that are smaller than both the expected nominal value, and the value measured by DCPMS. For the 3-D LEAP tomographic operating conditions we employed, Si evaporates exclusively as $^{28}Si^{2+}$, whose peak in the mass spectrum lies in the decay tail of the $^{27}Al^{2+}$ peak, further reducing the accuracy of the concentration measurement. The $Si^{2+}$ concentration is measured to be less than both the nominal and DCPMS measured values (Table 2).

Creep Experiments

Constant load compressive creep experiments were performed at 400±1° C. on cylindrical samples with a diameter of 10 mm and a height of 20 mm. The samples were heated in a three-zone furnace, and the temperature was verified by a thermocouple placed within 1 cm of the specimen. The samples were placed between boron nitride-lubricated alumina platens and subjected to uniaxial compression by Ni superalloy rams in a compression creep frame using dead loads. Sample displacement was monitored with a linear variable displacement transducer with a resolution of 6 μm, resulting in a minimum measurable strain increment of $3\times10^{-4}$. When a measurable steady-state displacement rate was achieved for a suitable duration, the applied load was increased. Thus, a single specimen yielded minimum creep rates for a series of increasing stress levels, at the end of which the strain did not exceed 11%. Strain rates at a given load were obtained by measuring the slope of the strain versus time plot, in the secondary, or steady-state, creep regime.

Microstructure

Figure 7A:
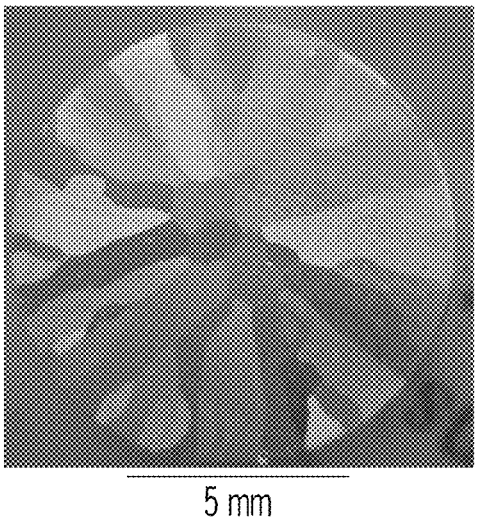
FIGS. 7A-7H depicts optical and SEM micrographs of Al-0.06 Zr-0.06 Sc-0.04 Si and Al-0.06 Zr-(0.05 Sc-0.01 Er)-0.04 Si after heat treatment.
Figure 7B:
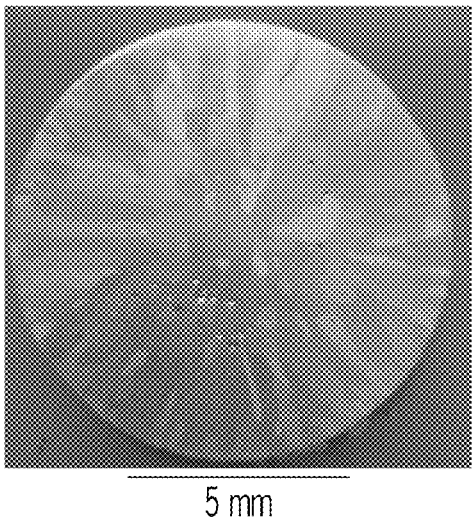
Figure 7C:
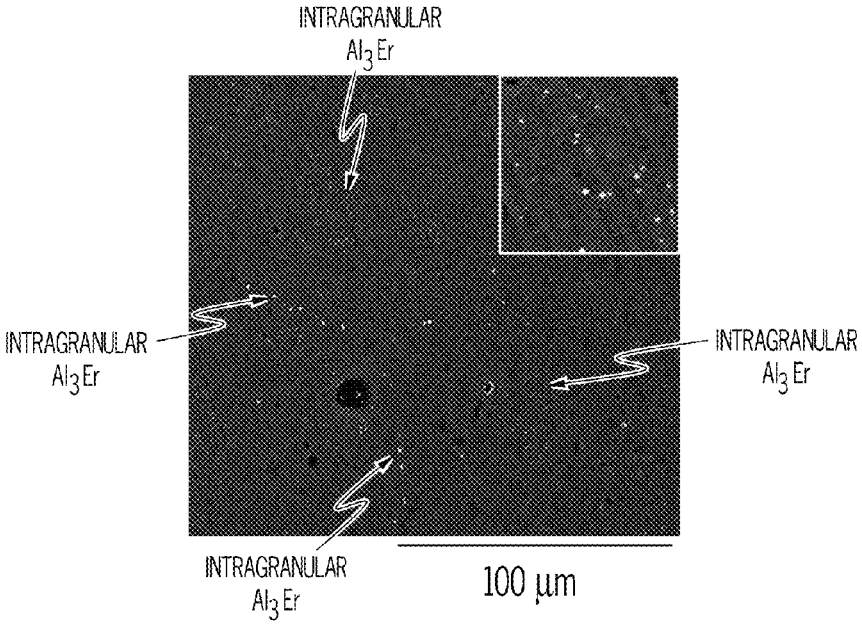

The microstructures of the peak-aged Er-free (Alloy 4) and Er-containing (Alloy 5) alloys are displayed in FIGS. 7*a* and 7*b*, respectively. The grains in both alloys are elongated radially along the cooling direction, with smaller grains at the center of the billet, as expected for cast alloys. Alloy 5 has smaller grains than Alloy 4, with a larger grain density of 2.1±0.2 compared to 0.5±0.1 grains $mm^{-2}$, as determined by counting grains in the billet cross-sections. The finer grain structure in Alloy 5 is due to intergranular $Al_3Er$ precipitates with trace amounts of Sc and Zr, with diameters of about 2 μm, visible in FIG. 7C, and with compositions verified by semi-quantitative EDS. These particles inhibit grain growth after solidification and/or during homogenization. Such primary precipitates were not observed in Alloy 4, indicating that the solubility limit of Alloy 5 was exceeded during solidification and heat-treatment. The addition of Sc and Zr has thus significantly decreased the 0.046 at. % solubility of Er in a binary Al—Er alloy. The Er concentration, as measured by 3-D LEAP tomography in the matrix of the peak-aged Er-containing alloy (Alloy 5) is 0.0044±0.0005 at. %.

Thus, less than half of the nominal value of 0.01 at. % Er is available for nanoscale precipitates formed on aging, while the remainder is present in the coarser primary $Al_3Er$ precipitates. Alloy 5 also contains submicron intragranular $Al_3Er$ precipitates, FIG. 7C, which is probably a result of microsegregation during solidification. The first solid to form in dilute Al—Zr—Sc—Er alloys is enriched in Zr, resulting in a microstructure consisting of Zr-enriched dendrites surrounded by Sc and Er-enriched interdendritic regions.

In summary, the presence of $Al_3Er$ primary precipitates refines the grain size and reduces the effective Er concentration available for strengthening nanoscale precipitation. In the following, the nominal compositions are used to label the alloys.

Nanostructure of Peak-Aged Alloys

Figure 8A:
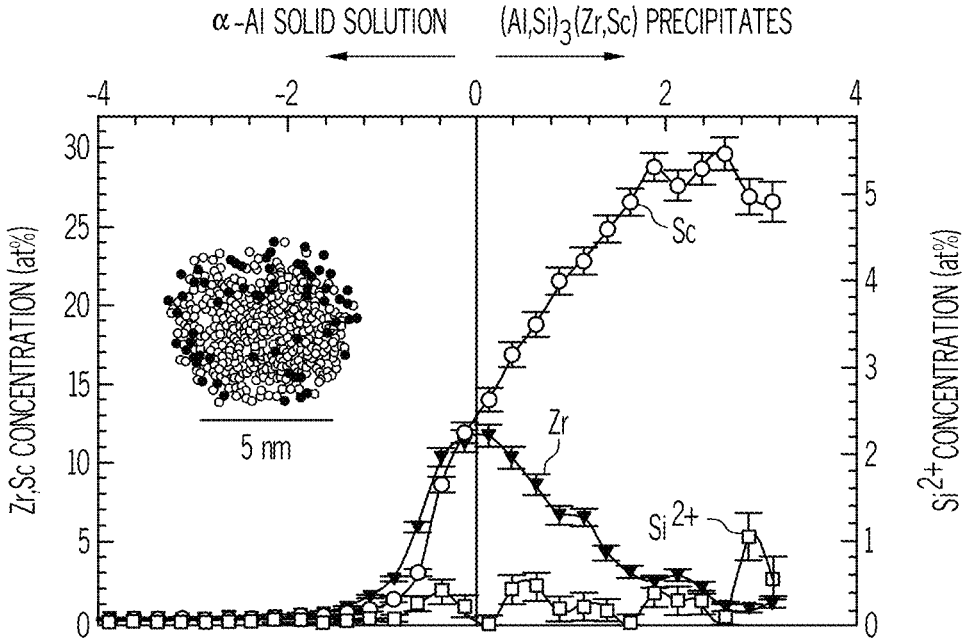
FIGS. 8A and 8B are graphical illustrations of average concentration profiles across the matrix/precipitate interface after a two-stage peak-aging treatment (4 h at 300° C. followed by 8 h at 425° C.) for Al-0.06 Zr-0.06 Sc-0.04 Si (FIG. 8A) and Al-0.06 Zr-(0.05 Sc-0.01 Er)-0.04 Si (FIG. 8B), which were obtained using 3-D APT.
Figure 8B:
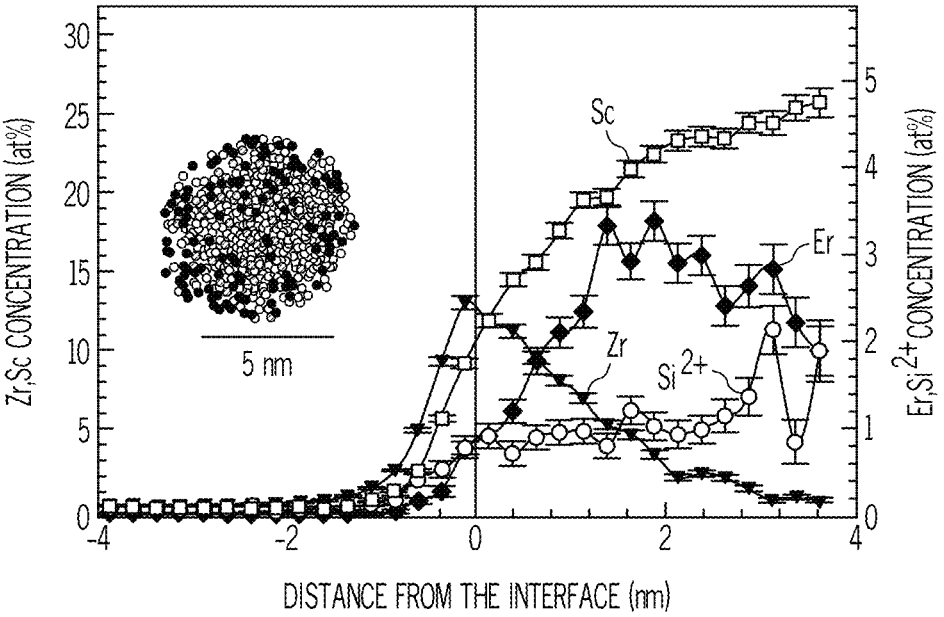

The nanostructures of Alloys 4 and 5, after aging isothermally for 4 h at 300° C. and 8 h at 425° C., were compared employing 3-D LEAP tomography. The spheroidal precipitates in the Er-free alloy (Alloy 4) consist of a Sc-enriched core surrounded by a Zr-enriched shell, as shown in FIG. 8. The precipitates have an average radius of 2.4±0.5 nm, a number density of $2.5\pm0.5\times10^{22}$ $m^{-3}$ and a volume fraction of 0.259±0.007%. The spheroidal precipitates in the Er-containing alloy (Alloy 5) consist of a core enriched in both Er and Sc surrounded by a Zr-enriched shell, with an average radius, <R>, of 2.3±0.5 nm, a number density, $N_v$, of $2.0\pm0.3\times10^{22}$ $m^{-3}$, and a volume fraction, $\phi$, of 0.280±0.006%. Silicon partitions to the precipitate phase and shows no preference for the precipitate core or shell in either alloy.

The precipitate and matrix compositions of the two alloys demonstrate that all alloying additions (Si, Zr, Sc and Er) partition to the precipitate phase. The matrix of the Er-containing alloy (Alloy 5) is more depleted of solute, with a composition of 107±12 at. ppm Zr, 32±4 at. ppm Sc and 7±4 at. ppm Er, than that of the Er-free alloy (Alloy 4), with a composition of 153±28 at. ppm Zr, 89±14 at. ppm Sc.

Peak-Aged Condition

The as-cast microhardness values of Alloys 4 and 5 are 256±4 and 270±8 MPa, respectively. These microhardness values are larger than those of previous as-cast dilute Al—Sc—X alloys, with comparable solute contents, of 210-240 MPa. The larger microhardness values may be evidence of early-stage clustering or precipitation, possibly as a result of the addition of Si, which accelerates precipitate nucleation in an Al-0.06 Zr-0.06 Sc at. % alloy aged at 300° C. After homogenization and peak-aging, the microhardness values of the present alloys increase to 627±10 and 606±20 MPa, respectively.

Figure 9:
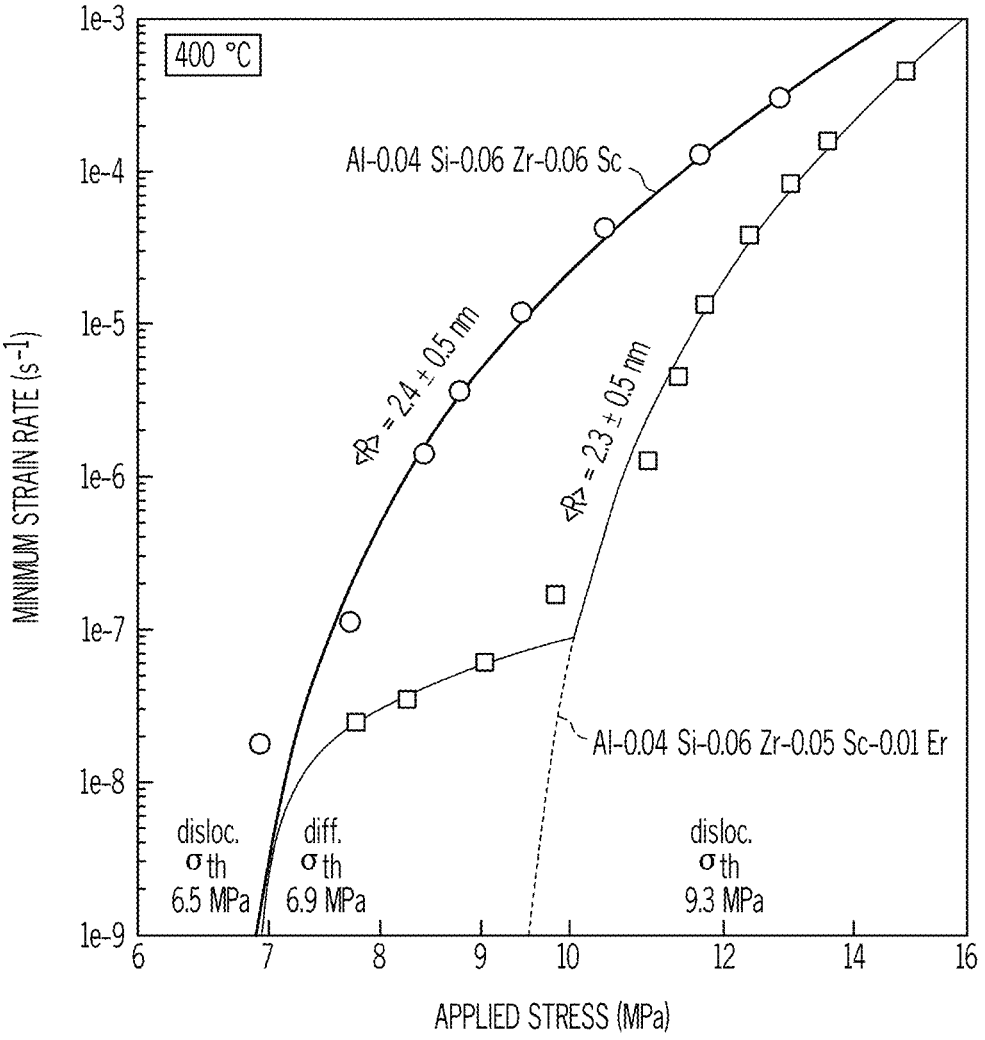
FIG. 9 is a double logarithmic plot of minimum creep rate versus applied stress for compressive creep experiments at 400° C. for Al-0.06 Zr-0.06 Sc-0.04 Si and Al-0.06 Zr-(0.05 Sc-0.01 Er)-0.04 Si after heat treatment.

FIG. 9 displays the minimum compressive strain rate versus uniaxial compressive stress at 400° C. for Alloys 4 and 5 tested in the peak-aged condition. The apparent stress exponent for dislocation climb-controlled creep for Alloy 4 (measured over the range 7-13 MPa) is 16±1, which is significantly greater than that of 4.4 expected for Al. Larger than expected stress exponents were previously measured in other Al—Sc-based alloys and are indicative of a threshold stress for creep, below which dislocation creep is not measureable in laboratory time frames.

Figure 7D:
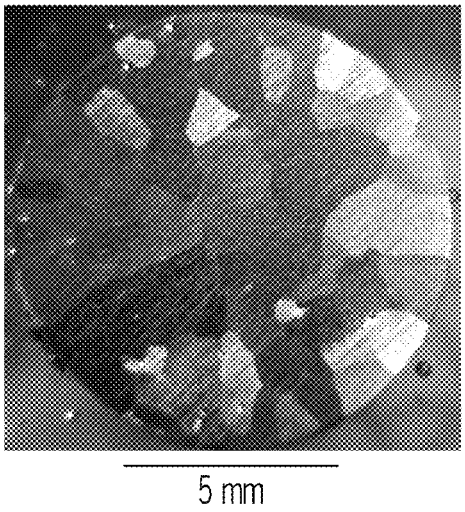
Figure 7E:
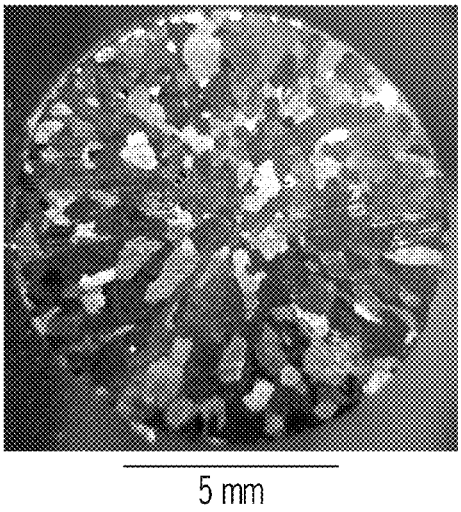
Figure 7F:
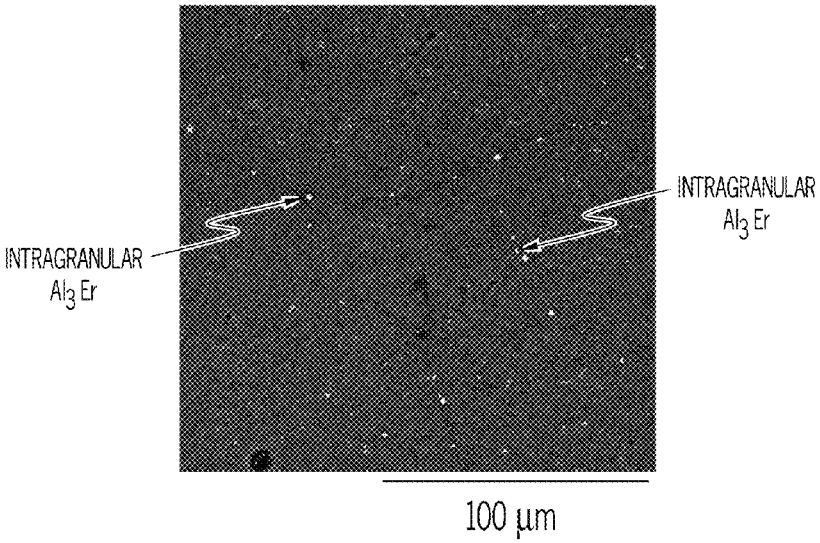

The microstructures of Alloys 4 and 5 following creep testing at 400° C. are displayed in FIGS. 7D and 7E, respectively. After creep at 400° C., the grains in Alloy 4 (FIG. 7D) appear unchanged with 0.6±0.1 grains $mm^{-2}$, compared to the 0.5±0.1 grains $mm^{-2}$ before creep (FIG. 7A). The grains in Alloy 5 following creep (FIG. 7E) have undergone recrystallization, resulting in an increase in the grain density to 3.6±0.2 grains $mm^{-2}$ from the pre-creep value of 2.1±0.2 (FIG. 7B). The intergranular $Al_3Er$ precipitates remain following creep (FIG. 7F).

Over-Aged Condition

To collect more data in the diffusional creep regime of Alloy 5, a second series of creep experiments was performed at 400° C. on another peak-aged sample, beginning at a lower applied stress of 6 MPa. Compressive creep data were collected over 325 h for four stresses ranging from 6-8.5 MPa, which yielded a nearly constant strain rate of $1.2\pm0.2\times10^{-8}\ s^{-1}$, where the error is the standard deviation of the four resulting strain rates. A constant strain rate for increasing applied stress is indicative of an evolving microstructure, that is, grain growth during the creep test. Since the rate of diffusional creep at a given stress decreases with increasing grain size, grain growth can account for the nearly constant strain rate measured between 6 and 8.5 MPa.

Figure 10:
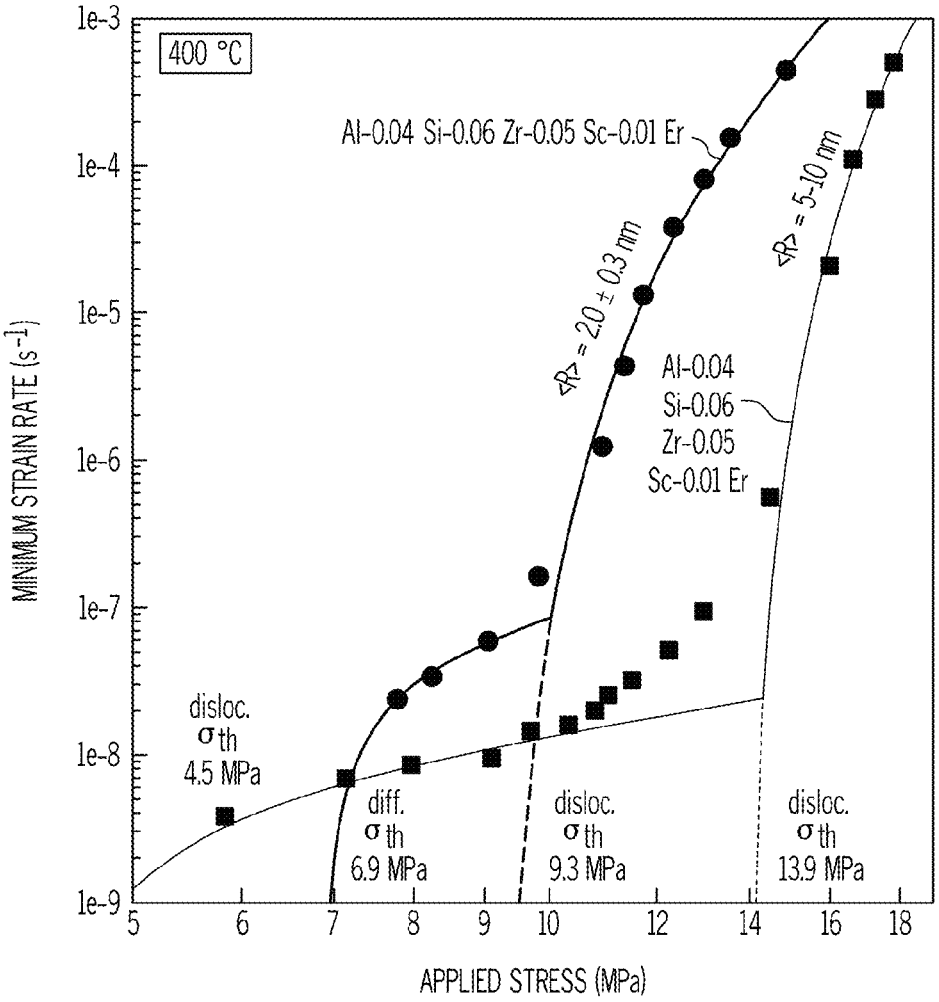
FIG. 10 is a double logarithmic plot of minimum creep rate versus applied stress for compressive creep experiments at 400° C. for Al-0.06 Zr-(0.05 Sc-0.01 Er)-0.04 Si (a) after a two-stage peak-aging treatment (4 h/300° C. and 8 h/425° C.) and (b) after subsequent exposure at 400° C. for 325 h at applied stresses ranging from 6 to 8.5 MPa.

The applied stress was then removed, and the sample was held in the creep frame for 48 h at 400° C. to allow for a full recovery of the dislocation microstructure. Creep testing of the sample, by then at 400° C. for 373 h (15.5 days), and labeled in the following as "over-aged," was then resumed, beginning at a stress of about 6 MPa and lasting 672 hours (28 days), most of it spent below 13 MPa. The results of this series of tests on the over-aged sample are displayed in FIG. 10, and compared to those obtained for the peak-aged alloy. For all measured stresses, the creep rates of the over-aged Er-containing alloy (Alloy 5) are lower than in the peak-aged condition, in some cases by about three orders of magnitude. In the dislocation creep regime at high stresses (14-18 MPa), an apparent stress exponent of 29±2 is again indicative of a threshold stress, which is determined to be 13.9±1.6 MPa. In the diffusional creep regime at low stresses (6-11 MPa), the apparent stress exponent is 2.5±0.2, and the threshold stress is 4.5±0.8 MPa. A transition region between diffusional and dislocation creep between 11 and 13 MPa is observed, which was not present in the peak-aged sample.

Figure 7G:
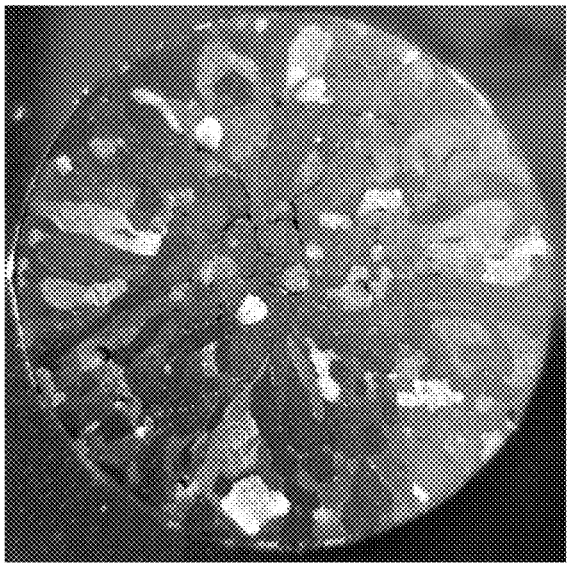
Figure 7H:
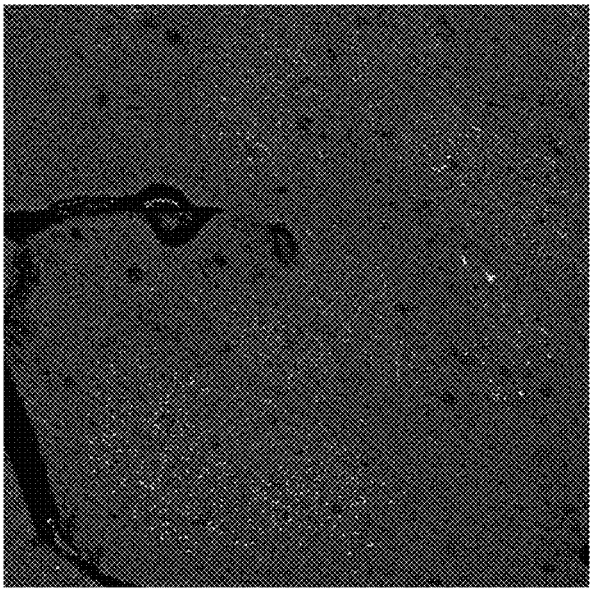

The microstructure of the over-aged alloy after a total of 1045 h (43.5 days) in the creep frame at 400° C., is shown in FIG. 7G. There is evidence of void-formation at the grain boundaries, and of significant coarsening of the intragranular $Al_3Er$ precipitates as compared to the peak-aged state, FIG. 7B. The formation of voids may be due to tensile stresses developing perpendicular to the applied compressive load, resulting from slight barreling of the sample during compressive creep testing. It is likely that these voids formed after considerable strain had accumulated in the sample, and they may thus affect the last few creep data points measured at the highest stresses, resulting in higher than expected strain rates. The over-aged sample exhibits a microhardness of 436±10 MPa, following 1075 h of creep at 400° C., which is, as anticipated, below the peak-aged value of 606±20 MPa.

The grains are slightly larger in the Er-containing alloy (Alloy 5) that was exposed for 1045 h at 400° C., with a larger grain density of 3.1±0.2 grains $mm^{-2}$, as compared to the 3.6±0.2 grains $mm^{-2}$ from the Er-containing sample exposed for 123 h. 3-D LEAP tomographic analysis of the crept material revealed a number density of precipitates of $2\pm1\times10^{21}\ m^{-3}$, where the high degree of error is because only five precipitates were detected in a 50 million atom dataset, all of which were only partially bound by the tip volume. Given the poor precipitate statistics, detailed compositional and structural analyses were not possible, though the precipitate radius was estimated by eye from the 3-D LEAP tomographic reconstruction to be 5-10 nm. Assuming that the volume fraction of precipitates is constant for the peak-aged and overaged sample, and using the measured number density of $2\pm1\times10^{21}\ m^{-3}$, a radius of 6-9 nm is calculated for the spheroidal precipitates, in good agreement with the above estimate.

Accordingly, the disclosed aluminum alloys having additions of scandium, zirconium, erbium and, optionally, silicon, exhibit good mechanical strength and creep resistance at elevated temperatures.

Although various aspects of the disclosed aluminum alloy and method have been shown and described, modifications may occur to those skilled in the art upon reading the specification. The present application includes such modifications and is limited only by the scope of the claims.

What is claimed is:

1. An aluminum alloy consisting of: a non-zero quantity of scandium present at a concentration of at most about 0.1 at. %; a non-zero quantity of zirconium present at a concentration of at most about 0.1 at. %; a non-zero quantity of erbium present at a concentration of at most about 0.05 at. %; from 0 to about 0.1 at. % silicon; and aluminum forming substantially the balance of said aluminum alloy.

2. The aluminum alloy of claim 1 wherein iron is present in said aluminum alloy as an impurity.

3. The aluminum alloy of claim 1 wherein the content of silicon is at least about 0.02 at. %.

4. The aluminum alloy of claim 1 wherein: the content of erbium is at most about 0.04 at. %; and the content of silicon is 0 at. %.

5. The aluminum alloy of claim 1 wherein: the content of erbium is at most about 0.04 at. %; and the content of silicon is 0 at. %.

6. The aluminum alloy of claim 1 wherein:
the content of scandium is at most about 0.08 at. %;
the content of zirconium is at most about 0.08 at. %;
the content of erbium is at most about 0.04 at. %; and
the content of silicon is at most about 0.08 at. %.

7. The aluminum alloy of claim 1 wherein:
the content of scandium is at most about 0.06 at. %;
the content of zirconium is at most about 0.06 at. %;
the content of erbium is at most about 0.02 at. %; and
the content of silicon is at most about 0.04 at. %.

8. The aluminum alloy of claim 2 wherein the content of iron is at most about 0.0025 at. %.

* * * * *